US005102125A

United States Patent [19]

Van Der Hoeven

[11] Patent Number: 5,102,125

[45] Date of Patent: Apr. 7, 1992

[54] MULTI-FUNCTIONAL EXERCISING APPARATUS

[76] Inventor: Martin A. Van Der Hoeven, #303 3330 Carlsbad Blvd., Carlsbad, Calif. 92008

[21] Appl. No.: 703,012

[22] Filed: May 20, 1991

Related U.S. Application Data

[63] Continuation-in-part of Ser. No. 603,454, Oct. 25, 1990, and a continuation-in-part of Ser. No. 395,537, Aug. 18, 1989, Pat. No. 5,005,832, and a continuation-in-part of Ser. No. 360,133, Jun. 1, 1989, Pat. No. 4,966,363, which is a continuation-in-part of Ser. No. 156,404, Feb. 16, 1988, Pat. No. 4,848,740.

[51] Int. Cl.[5] ..... A63B 21/05

[52] U.S. Cl. ..... 482/128; 482/126; 482/121

[58] Field of Search ..... 272/67, 68, 93, 130, 272/135-143; 128/26

[56] References Cited

U.S. PATENT DOCUMENTS

| | | | |
|---|---|---|---|
| 1,548,849 | 8/1925 | Ruden | 272/141 X |
| 2,118,684 | 5/1938 | Prescott | 272/67 X |
| 3,447,415 | 6/1969 | Kime | 272/67 X |
| 3,738,651 | 6/1973 | Norman et al. | 272/67 |
| 4,257,590 | 3/1981 | Sullivan et al. . | |
| 4,364,559 | 12/1982 | Valentine | 272/142 |
| 4,428,577 | 1/1984 | Weingardt | 272/135 |
| 4,515,364 | 5/1985 | Rotella | 272/135 X |
| 4,678,181 | 7/1987 | Ditsch et al. | 272/68 |
| 4,750,734 | 6/1988 | Greenfield | 272/135 X |
| 5,016,874 | 5/1991 | Boardman | 272/135 X |

FOREIGN PATENT DOCUMENTS

| | | | |
|---|---|---|---|
| 650407 | 7/1985 | Switzerland | 272/130 |
| 1289516 | 2/1987 | U.S.S.R. | 272/135 |
| 456223 | 11/1936 | United Kingdom | 272/68 |

*Primary Examiner*—Robert Bahr
*Attorney, Agent, or Firm*—Henri J. A. Charmasson

[57] ABSTRACT

A multi-functional apparatus for the development or rehabilitation of the entire human musculature is packaged in a compact and lightweight housing. It combines three sets of exercising arms which can be biased against either pushing or pulling movements. The first set has parallel arms working in a front/back horizontal direction. The second set offers incline, back-to-back arms operating in sideways, horizontal direction. The third set features a pair of parallel arms moving in a vertical direction. Each arm can be operated with a hand or a foot.

9 Claims, 1 Drawing Sheet

MULTI-FUNCTIONAL EXERCISING APPARATUS

PRIOR APPLICATION

This application is a continuation-in-part of co-pending Ser. No. 07/603,454, filed Oct. 25, 1990, a continuation-in-part of applications Ser. No. 07/395,537 filed Aug. 18, 1989, now U.S. Pat. No. 5,005,832 and of Ser. No. 07/360,133 filed June 1, 1989, now U.S. Pat. No. 4,966,363 which was a continuation-in-part of Ser. No 07/156,404 filed Feb. 16, 1988, now U.S. Pat. No. 4,848,740.

FIELD OF THE INVENTION

This invention relates to the field of athletic equipment used for muscle development or rehabilitation and more particularly this invention relates to multi-functional exercise devices for home use.

BACKGROUND OF THE INVENTION

The ever increasing popular field of body development and exercise activity has spurred the introduction of varied exercise apparatuses. Some of those apparatuses such as a climber are intended to exercise the cardio-vascular system or to develop a particular section of the human musculature such as the leg muscles. Others combine in a rack of plurality of devices which can be separately used to rehabilitate or develop specific parts of the musculature. The combined devices sometimes share a common weight stack through pulleys and cables in order to reduce the size and weight of the installation. These attempts at lightening and reducing the size of the machinery fall short of providing a comprehensive set of exercisers which can be had at a reasonable price, and which does not require extensive surface areas while in use or in storage. Furthermore, none of the prior devices can provide for a wide range of exercises or even include a recumbent cardio-vascular system exerciser.

SUMMARY OF THE INVENTION

The principal and secondary objects of this invention are to provide a multi-functional and versatile anaerobic and aerobic exercising apparatus which can be used to rehabilitate or develop a large number of elements of the human musculature and improve the cardio-vascular system,

- to replace a large number of cumbersome and expensive separate exercising machines, each dedicated to the exercise and development of a particular set of muscles; and
- to drastically reduce the working and storage space requirements for comprehensive anaerobic and aerobic equipment.

These and other objects are achieved by means of a compact and light-weight apparatus which consists essentially of a housing from which a first pair of resiliently biased arms project out of a front wall, a second pair of resiliently biased arms project in opposite directions from side walls, and a third pair of resiliently biased arms project in a parallel and upward direction from the top. Each arm terminates in a hand assembly comprising a push-plate and a handle extending in a right-angled configuration from the push-plate. Carriage having a upper surface shaped and dimensioned to receive the heels of the operator run along tracks under each of the first and second pair of arms. The apparatus is light enough to be held off the ground for some exercises. For most exercises the apparatus need only to be laid against a wall. For some pulling exercises it is necessary that the apparatus be anchored to the floor, a wall or a table top.

The apparatus may be used to perform the following body exercises:

1) While laying on his back with the head toward the apparatus, the operator, by grabbing the handles at the end of the first pair of arms and pushing against the resilient bias of the arms, can exercise triceps and deltoids.
2) While in a sitting or standing position, the operator may grab the handles at the end of the first pair of arms and push to develop triceps and serratus anterior.
3) Laying back or relaxing with legs toward the apparatus, placing his heels in the carriage associated with the first pair of arms and pushing against the plates, the operator will exercise his quadriceps and glutaeus maximus.
4) In the same position, alternate pressing movements of the legs at progressively increased speed constitutes an aerobic exercise.
5) While laying on his back with legs toward the apparatus, the heels resting on the stationary carriages and pushing with the forefoot against the push plates of the first set of arms, the operator will exercise his gastrocnemius with the knees extended, and the soleus with the knees bent.
6) By placing the plate associated with the first pair of arms against his abdomen, then grabbing the handles associated with the second pair of arms, and pulling the entire apparatus toward him, the operator can perform exercises beneficial to the latissimus dorsi and biceps with palms up, and the brachialis with palms down, as well as the rectus abdominis through isometric contractions of the abdominal musculature.
7) Sitting or laying on his back with both heels resting on the carriages associated with the lateral arms, and pushing with the inner side of each foot against the pushplates will develop adductors.
8) Pushing in the opposite direction, that is with the outer side of the foot against handles constitutes an exercise for the development of abductors, glutaeus medius and tensor fasciae latae.
9) When the first of the last two exercises is practiced with hands and arm, the inward pushing movement develops the pectoralis major.
10) The second pulling exercise done with hands and arms favors the scapular muscles, the posterior deltoid, the
11) Using the vertical arms in a standing or sitting position, and pushing down with one or both hands on the handles will exercise the triceps and latissimus dorsi whether the exercise is performed with elbows bent or extended.
12) Hamstrings may be exercised by sitting and pressing with each foot against the push plates. The following described exercise requires that the apparatus be anchored to the floor, to wall or a work surface.
13) While laying back, with head toward the device, the operator can pull on the first set of arms to develop his biceps and latissimus dorsi.
14) The same pulling exercise can also be practiced in a sitting position, palms up.

15) If the exercise is palm down, the brachialis will be exercised along with the latissimus dorsi.

16) Laying on his back with legs toward the device and heels on the carriages associated with the first set arms, and the forefoot inserted between the push plate and handles will develop the hamstrings, iliacus and psoas major.

17) The same exercise with heel kept stationary while pulling with the forefoot will favor the ankle dorsiflexors.

18) Another biceps exercise can be practiced in a sitting or standing position by lifting the third pair of arms with elbows bent and arms up.

19) The same exercise will, with palms down, favor the brachialis.

The same exercise practiced with arms outstretched will help develop anterior deltoids.

20) From a sitting position, the operator can place his forefoot between the push plate and handle of the third pair of arms and pull them upward alternately by lifting his legs to develop abdominals, psoas major and iliacus.

DESCRIPTION OF THE PREFERRED EMBODIMENT OF THE INVENTION

Figure 1:
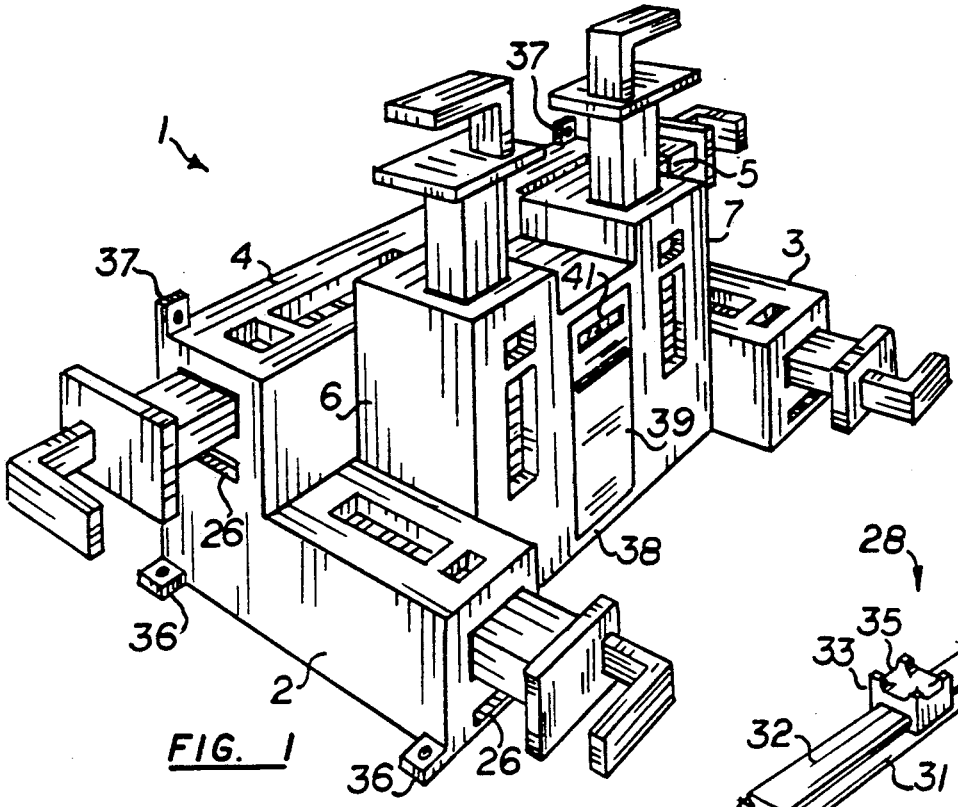
FIG. 1 is a perspective view of the multi-functional exercising apparatus.
Figure 4:
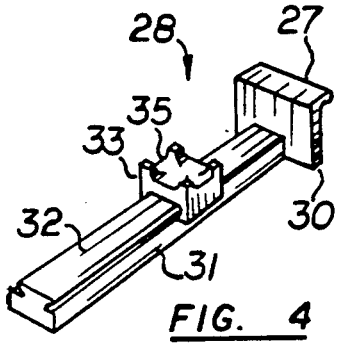
FIG. 4 is a perspective view of a heel carriage and slide assembly.
Figure 2:
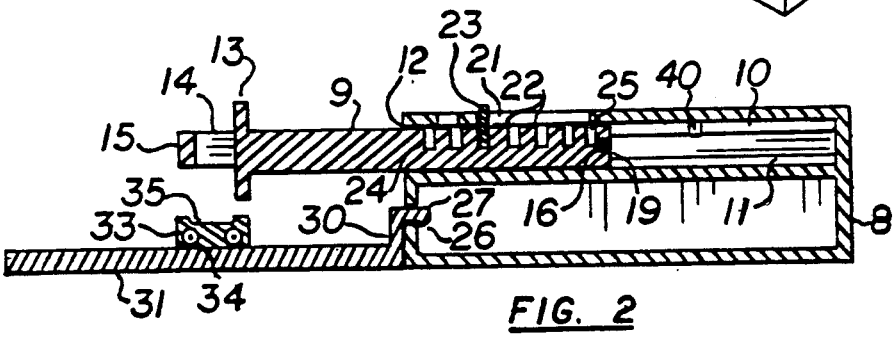
FIG. 2 is a vertical, median cross-sectional view of an arm assembly.
Figure 3:
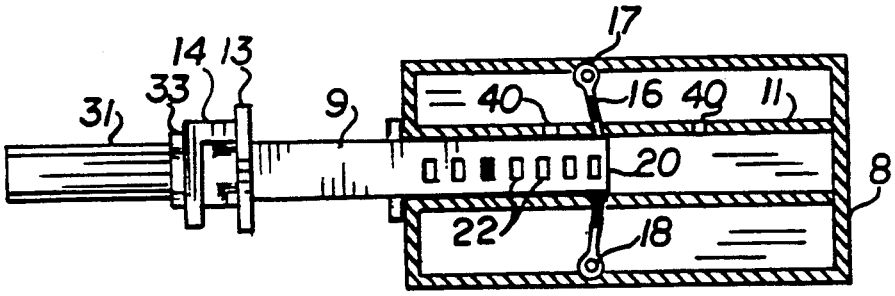
FIG. 3 is a median, horizontal, cross-sectional view thereof.

Referring now to the drawing, FIG. 1 illustrates a complete exercising apparatus 1 which consists essentially of a combination of six identical assemblies 2, 3, 4, 5, 6, and 7 arranged into three sets; each operating along one of three orthogonal directions. The first pair of assemblies 2, 3 are laid in a parallel configuration in a front to back direction. The second pair of assemblies 4, 5 are arranged in a back to back in line configuration along a left/right axis, and above the planes occupied by the first pair 2, 3. The third pair of assemblies 6, 7 are arranged in a side by side parallel configuration in a vertical direction. The internal configuration of each assembly is illustrated in FIGS. 2 and 3. Each assembly comprises a housing 8 which is integral with the housing of the adjacent assemblies. A sliding arm 9 runs between two parallel tracks 10, 11 within the housing and extends outside the housing through an opening 12. The distal or upward end of the arm 9 is terminated by a push-plate 13 from which extends a L-shaped member 14 forming a handle 15 perpendicular to the axis of the sliding arm 9. An elastic cord 16 stretched between two anchor points 17, 18 inside the housing 8 on opposite sides of the tracks 10, 11 passes through a transversal bore 19 near the internal or proximal end 20 of the arm 9. A slot window 21 cuts into the upper track 10 and roof of the housing 8 gives access to a series of peg-holes 22 in the top inner half of the sliding arm 9. A peg 23 inserted through the window 21 into one of the arm holes 22 is used to preset a certain amount of tension of the arm 9 against the elastic cord 16 in either direction. In other words, the position of the peg 23 determines whether the elastic cord 16 applies a resilient bias against penetration of the arm 9 into the housing, or a resilient bias against extraction of the arm 9 out of the housing. For instance, placing the peg in the outermost hole 24 will tension the arm against penetration into the housing. Placing the peg in the innermost hole 25 will tension the arm against any extracting movement. The housings of the first and second pairs of assemblies 2, 3, 4, and 5 have a slot opening 26 located immediately under the arm opening 12. This slot is sized and dimensioned to be engaged by the connecting nib 27 of a carriage assembly 28 shown in perspective in FIG. 4. The nib 27 has a slightly enlarged head which snaps into the slot to positively lock the carriage assembly 28 against the face of the housing. The nib 27 extends from a positioning plate, and a track 31 projects orthogonally from the plate immediately under the traveling space of the handle 15 and push-plate 13 assembly. The track 31 has a dovetail rail 32 which is engaged by, and upon which run, a carriage 33. The carriage 33 has internal rollers 34 bearing against the rail 32, and a concavely arcuate top surface 35 which is shaped and dimensioned to support a human heel whether the leg is perpendicular or orthogonal to the sliding movement of the arm 9 and associated carriage 33. Four anchoring brackets 36 are provided around the base of the apparatus and two anchoring brackets 37 are provided along the upper back edge.

In a seventh housing 38 located between the third pair of assemblies 6, 7 is installed a sound-reproducing machine 39 which is used to play sets of coaching instructions and pace-setting music from sound recordings. The various segments of the coaching program may be started and synchronized by electrical signals derived from switches 40 located along the tracks of each arm assembly. The number of switch activations are totalized and displayed on a readout 41.

While the preferred embodiments of the invention have been described, modifications can be made and other embodiments may be devised without departing from the spirit of the invention and the scope of the appended claims.

What is claimed is:

1. A musculature exercising apparatus which comprises:

a generally quadrangular housing having a top, bottom, a first pair of parallel arms movably projecting in a first horizontal plane out of a first pair of openings in the front wall;

resilient means for outwardly biasing the first pair of arms against forced penetration of said arms into said housing;

a second pair of arms in line and movably projecting in opposite directions in a second horizontal plane out of a second pair of openings in said side walls; and means for outwardly biasing said second pair of arms against forced penetration of said arm into said housing.

2. The apparatus of claim 1, which further comprises:

a third pair of arms parallelly and movably projecting in a vertical plane through a third pair of openings in the top of the housing;

means for outwardly biasing said third pair of arms against forced penetration of said arms into said housing.

3. The apparatus of claim 2, which further comprises a push-plate and handle assembly at the outward end of each of said 4. The apparatus of claim 1, which comprises a track running under each arm of said first pair of arms; and a carriage running along said track, said carriage having a concavely arcuate upper surface sized and shaped to hold a heel of a recumbent operator.

5. The apparatus of claim 4, which further comprises a track lying under each arm of said second pair of arms; and a carriage running along said track and having a concavely arcuate upper surface sized and shaped to hold a heel of an operator.

6. The apparatus of claim 1, which further comprises means for resiliently and inwardly biasing each of said second pair of arms against forced extraction out of said housing.

7. The apparatus of claim 5, which further comprises means for inwardly biasing each of said first pair of arms against forced extraction out of said housing.

8. The apparatus of claim 7, which further comprises means for resiliently and outwardly biasing each of said third pair of arms against forced extraction out of said housing.

9. The apparatus of claim 8, wherein said means for biasing comprise an elastic cord having both ends anchored to said housing on either side of one of said arms, and a median section of said cord engaging said arm.

* * * * *